US005331691A

United States Patent [19]

Runckel

[11] Patent Number: 5,331,691

[45] Date of Patent: Jul. 26, 1994

[54] INTRA-ORBITAL SWIM GOGGLES

[75] Inventor: John L. Runckel, Lake Oswego, Oreg.

[73] Assignee: John L. Runckel Trust, Portland, Oreg.

[21] Appl. No.: 970,933

[22] Filed: Nov. 2, 1992

[51] Int. Cl.[5] ..... A61F 9/02

[52] U.S. Cl. ..... 2/428; 2/452

[58] Field of Search ..... 2/428, 430, 431, 432, 2/439, 440, 441, 447, 452; 351/43, 110

[56] References Cited

U.S. PATENT DOCUMENTS

| | | | |
|---|---|---|---|
| 850,997 | 4/1907 | Cover | 2/440 |
| 2,007,186 | 7/1935 | Farrell | 2/440 |
| 2,356,731 | 8/1944 | Balanon | 2/440 |
| 2,504,524 | 4/1950 | Hayward | 2/452 |
| 2,709,256 | 5/1955 | Baratelli | 2/428 X |
| 3,758,202 | 9/1973 | Chunga, Sr. | 351/110 X |
| 4,051,557 | 10/1977 | Bengtson et al. | 2/430 |
| 4,162,542 | 7/1979 | Frank | 2/430 X |
| 4,264,987 | 5/1981 | Runckel | 2/428 |
| 4,286,340 | 9/1981 | Lathrop | 2/430 |
| 4,348,775 | 9/1982 | Haslbeck | 2/452 |
| 5,191,364 | 3/1993 | Kopfer | 351/43 X |

FOREIGN PATENT DOCUMENTS

| | | | |
|---|---|---|---|
| 2603914 | 6/1977 | Fed. Rep. of Germany . | |
| 2923798 | 12/1979 | Fed. Rep. of Germany | 351/43 |

OTHER PUBLICATIONS

Copies of the front and back panel for the Monterbara Simglasogon goggle sold by M. Malmsten of Sweden.

*Primary Examiner*—Peter Nerbun
*Attorney, Agent, or Firm*—Kolisch, Hartwell, Dickinson, McCormack & Heuser

[57] ABSTRACT

An intra-orbitally engaging pair of swim goggles is described. The goggles include two eyepieces connected by a bridge and a fastener for securing the eyepieces over the user's eyes. Each eyepiece has a planar eye-shaped lens, upper and lower walls extending backward and culminating in an inwardly sloping intra-orbital facing rim. A conformable pad is affixed to the rim for comfortably engaging an inner wall of the user's eye orbit. The upper and lower walls of each eyepiece meet along a lateral ridge extending perpendicularly backward from the lens.

17 Claims, 4 Drawing Sheets

INTRA-ORBITAL SWIM GOGGLES

BACKGROUND OF THE INVENTION

The invention relates to protective eyegear for use in sports activities, particularly sports involving water contact where it is desirable to seal the eye in a chamber which is protected from the external aqueous environment.

Numerous goggle devices have been designed for use by swimmers in order to limit exposure of the swimmer's eyes to water and other potential irritants, such as chlorine, which are typically present in swimming pools. Most prior art swim goggles are designed to fit "extra-orbitally", meaning that the back rim of a cup-shaped eyepiece rests against the swimmer's external facial bones and soft structures which surround the eye orbit. There are several significant limitations with this type of design.

One problem with extra-orbitally fitting swim goggles is that they protrude outward from a swimmer's face creating water resistance when the swimmer moves horizontally through the water. Water resistance decreases swim speed and can cause goggle displacement when the swimmer pushes off from a wall or dives into a pool.

Another problem with most extra-orbitally fitting goggles is that they typically utilize a suction mechanism to seal the eyes from the external environment. Suction inducing goggles tend to cause pain, and in severe cases, tissue and lymphatic damage.

Others have attempted to restrict goggle size in order to reduce water resistance. One approach is to reduce the lateral dimension of the goggle lens. A problem with this approach is that it limits the swimmer's peripheral vision which is particularly important in a competitive situation where the swimmer needs to be able to see other swimmer's in adjacent lanes. Another approach which has been tried to reduce goggle water resistance is to employ relatively shallow eyepiece walls in conjunction with a curved front lens. There are at least two problems with this approach. First, the curved lens tends to distort the swimmer's view. Second, excessively shallow eyepiece walls tend to position the lens too close to the swimmer's eye, causing interference with the user's eyelid and/or lash.

Thus, an object of the present invention is to provide a comfortable pair of swim goggles which produce minimal water resistance when worn by a swimmer.

Another object is for the swim goggles to allow good peripheral vision without distorting the swimmer's view.

Another object is for the goggles to seal the swimmer's eyes from the external environment without inducing a significant suction effect.

SUMMARY OF THE INVENTION

The objects stated above and other important objects are accomplished by the swim goggles of the present invention including a set of left and right eyepieces connected together by a bridge. Each eyepiece includes a planar eye-shaped lens, and a wall extending backward from the lens culminating in an inwardly sloping intra-orbital engaging padded rim. The upper rim portion of the wall is contoured to fit against the orbital roof portion of the swimmer's frontal bone. A fastening mechanism such as a strap is provided for securing the eyepieces over the swimmers eyes. When properly worn, the lens of each eyepiece is positioned below and backward from the swimmer's brow.

In a preferred embodiment, the upper and lower portions of the eyepiece wall join along a lateral ridge which extends backward and perpendicularly from the lens toward the swimmer's ear.

The swim goggle design of the present invention produces a seal around the user's eye by conforming to the contours of the inner wall of the user's eye orbit without producing a significant suction effect. The goggle design provides a beneficial balance between the objectives of minimal water resistance, good peripheral and substantially distortion-free viewing, and comfortable non-suction sealing of the eye from the external environment.

DETAILED DESCRIPTION OF THE PREFERRED EMBODIMENTS

The swim goggles of the present invention are different from previous goggle designs in a number of respects. One important difference is that the upper wall of the eyepiece in the present invention is configured to fit within the user's eye orbit so that the lens and upper wall of the eyepiece do not extend substantially beyond the user's brow and forehead. In order to comfortably fit within the user's eye orbit, a sloping upwardly facing rim on the upper wall of each eyepiece forms an angle of at least about forty degrees, preferably about sixty degrees, with the plane of the lens. The upper wall of the eyepiece is shallow enough so that the lens can be positioned backward from the user's brow and forehead. The bottom wall is deeper than the top wall so that the lens is sufficiently displaced away from the eye to allow normal eyelid function. In contrast to prior goggle designs, the intra-orbitally engaging feature of the present invention provides a more streamlined profile relative to the user's head. Prior goggle designs which fit extra-orbitally protrude beyond the user's facial plane and are subject to water resistance causing decreased swim speed and possible displacement particularly when diving or pushing off from a pool wall. The intra-orbitally fitting goggles of the present invention are substantially contained within the profile of the user's face, thus minimizing water resistance.

Another feature of the present invention representing an important improvement over the prior art is the configuration of the eyepiece lens and wall. By combining a planar elongate eye-shaped lens within a wall which has a lateral ridge extending perpendicularly backward from the lens, an optimal balance is obtained between the competing goals of allowing good peripheral distortion-free viewing while minimizing water resistance.

Figure 1:
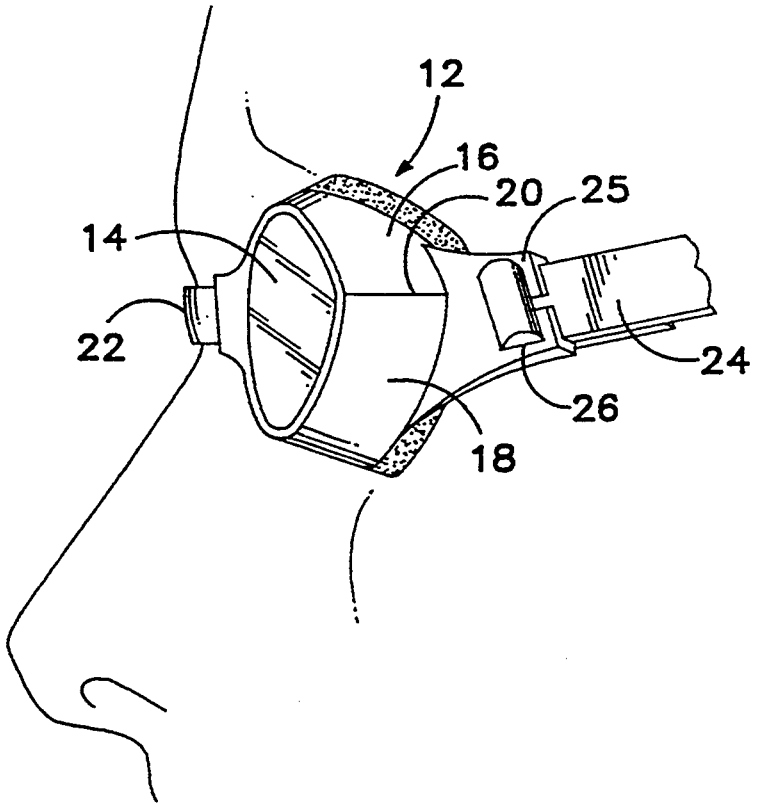
FIG. 1 is a perspective view of a left eyepiece in an embodiment of the present invention.

The inventors best mode of practicing the invention is illustrated in FIGS. 1–5. FIG. 1 illustrates a left eyepiece component 12 including a lens 14, an upper wall 16 and a lower wall 18 both extending backward from the lens 14 toward the user's face. The upper wall 16 joins the lower wall 18 along a lateral ridge 20 which extends backward and perpendicularly from the lens 14 toward the user's ear (not shown). The left eyepiece 12 is connected to a right eyepiece by a nose bridge 22. A fastening mechanism such as a strap 24 connects the lateral ends of the eyepieces in order to secure the eyepieces over the user's eyes.

A strap support flange 25 extends laterally upward from the side of the eyepiece. The flange 25 has rectangular apertures 26 which are perpendicular to a direction slightly upward from horizontal. The configuration of the flange 25 and its apertures 26 orient the strap in an upwardly pulling position so that the eyepiece is urged up against the inner side of the supra-orbital border.

When the goggles are properly worn, each eyepiece rests primarily on three places around the intra-orbital border. First, as noted above, the upper rim of each eyepiece rests inside of the supra-orbital border, exerting upward pressure against that upper portion of the orbit. Second, each eyepiece rests against the inner and outer corners of the bones which border the orbit, providing opposite lateral forces against the sides of the orbit. Third, the lower rim of each eyepiece rests against the lower border of each orbit.

Figure 2:
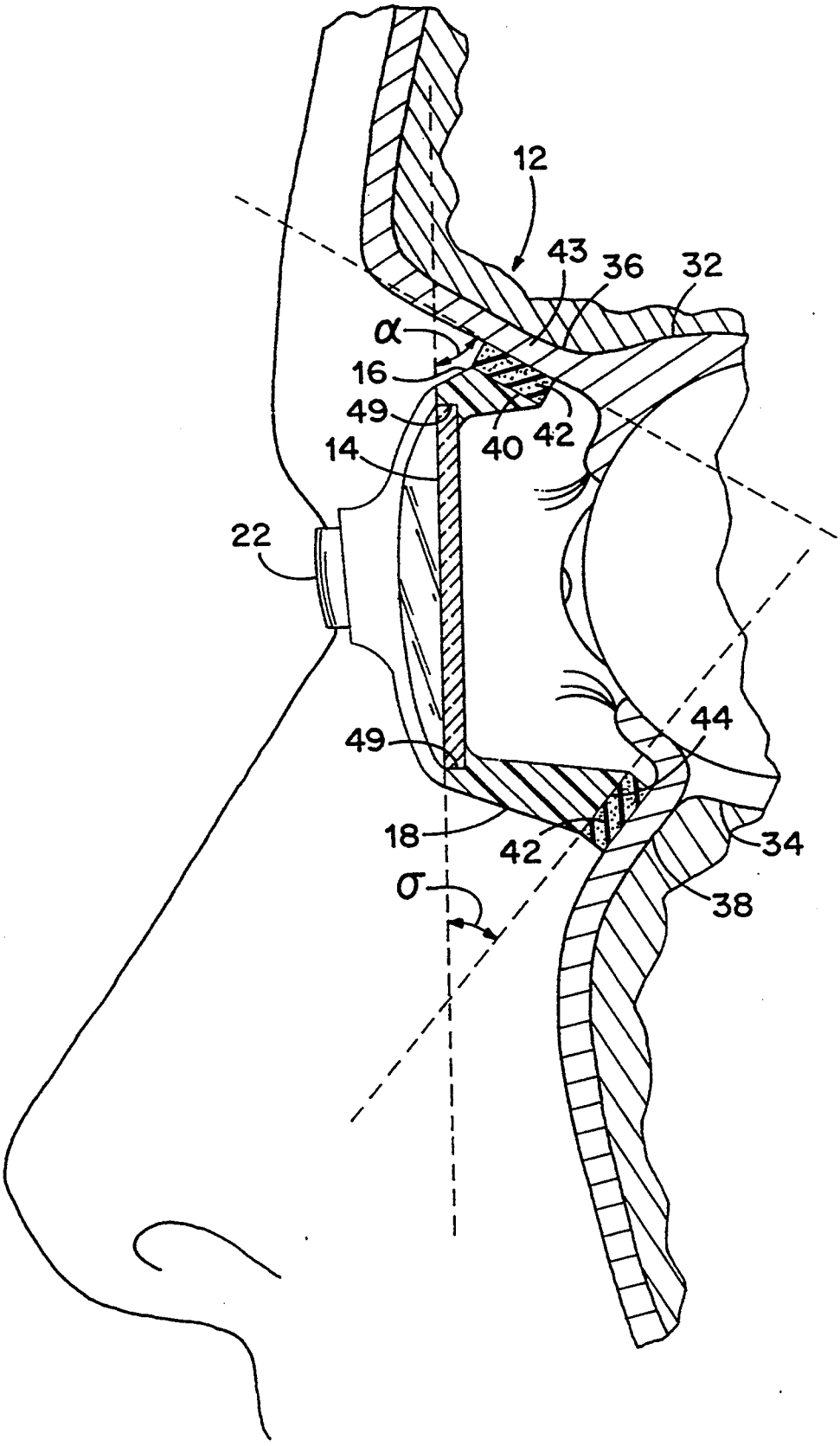
FIG. 2 is a side-sectional view of the eyepiece shown in FIG. 1.

FIG. 2 shows how the eyepiece fits against outer surfaces of the supra-orbital and infra-orbital bones. The orbit has a roof 32 which is formed by a portion of the frontal bone. A floor 34 of the orbit is formed primarily by the maxilla and zygomatic bones. The eye orbit is bounded along the top by a supra-orbital ridge or bone 36 and along the bottom by an infra-orbital ridge or border 38. FIG. 2 shows a sectional cut through the left eyepiece along an intermediate vertical plane which includes the center of the user's left pupil. The eye piece 12 has an upper wall 16 and a lower wall 18 extending backward from the lens 14 and culminating in an intra-orbital engaging padded rim.

The upper wall 16 of the eyepiece 12 has a back rim 40 which has a substantially planar face angled to conform to the user's supraorbital bone 36. A conformable pad 42 is affixed to the rim 40. The thickness of the pad is between approximately 2.0 to 6.0 millimeters, preferably 4.0 millimeters. The pad 42 engages the skin 43 which covers the forward roof portion of the orbit. The slope of the padded rim face forms an angle $\alpha$ with the plane of the lens of between forty degrees and eighty degrees. The angle $\alpha$ should be significantly less than ninety degrees in order to avoid undesirable penetration of the eyepiece wall between the eyeball and the roof of the orbit. Although the exact orientation of the supraorbital bone may vary slightly between different people, the conformable pad 42 compensates for small variations between the slope of the bone 36 relative to the slope of the rim 40. It has been experimentally determined that the most universally useful angle for the slope of the upper rim 40 relative to the lens plane is approximately sixty degrees.

The rim 44 of the lower wall 18 is sloped so that it faces the infra-orbital ridge 38. The slope of the rim 44 preferably forms an angle $\sigma$ with the plane of the lens of approximately forty degrees.

Along the intermediate sectional plane shown in FIG. 2, the width of the upper wall 16 from the lens to the beginning of the rim 40, is approximately 20% to 30% of the width of the bottom wall 18. This novel design feature allows the top of the eyepiece to be nested substantially behind the user's forehead and brow in relatively close proximity to the user's eye, while setting the bottom of the lens forward so that the entire lens is far enough in front of the user's eye to allow normal eyelid functioning.

In the preferred embodiment shown in FIG. 2, the lens 14 is a separate piece from wall portions 16 and 18. Lens 14 is planar so that it provides relatively distortion-free viewing. The lens is bonded into a circumferential stepped edge 49. It is important that the stepped edge 49 precisely complement the lens circumference and that a uniform bonding/sealing agent be used to secure the lens in the eyepiece so that no leakage occurs between the lens 14 and the eyepiece wall.

Figure 3A:
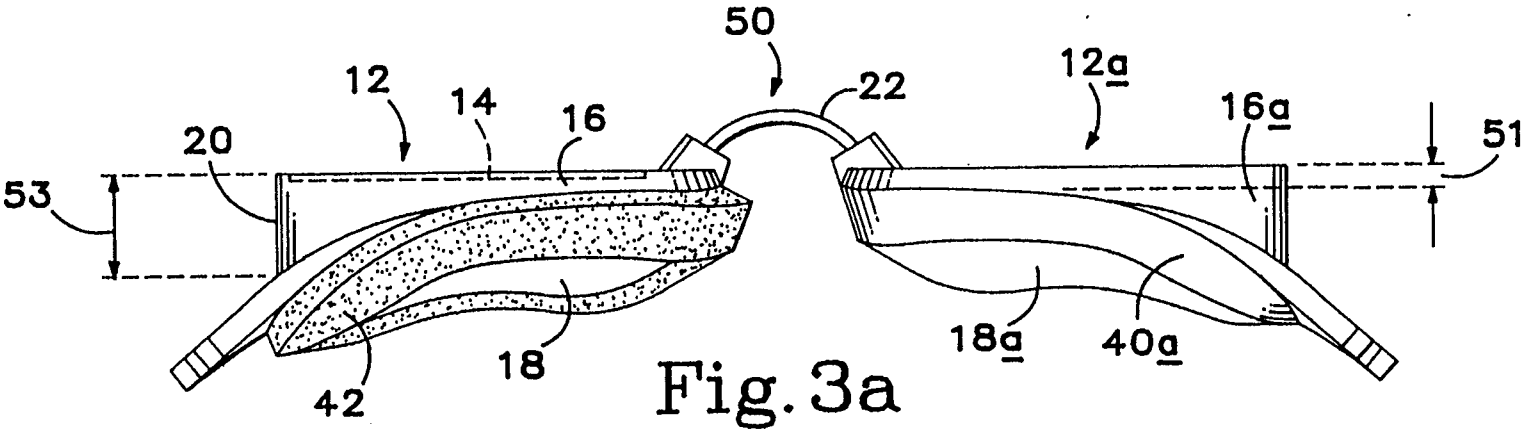
FIG. 3*a* is a top view of a pair of swim goggles in an embodiment of the present invention.
Figure 3B:
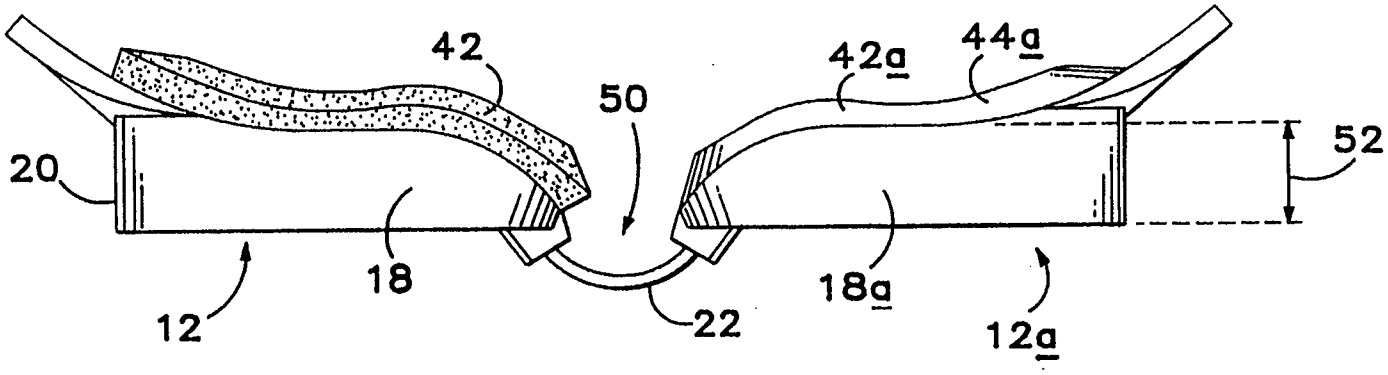
FIG. 3*b* is a bottom view of a pair of swim goggles of the present invention.

FIGS. 3*a* and 3*b* show top and bottom views respectively, of a pair of goggles 50 including the left eyepiece 12 and a right eyepiece **12*a* connected by a bridge 22. These figures demonstrate the differential wall widths with respect to the upper and lower walls of the eyepiece, which allow the top of the lens to be nested inside the orbit backward from the user's forehead and brow while simultaneously projecting the bottom of the lens forward far enough in front of the user's eye to allow normal eyelid functioning. In the preferred embodiment the intermediate width 51 of the upper wall is approximately 0.11 inch, whereas the intermediate width 52** of the lower wall is approximately 0.45 inch.

In FIGS. 3*a* and 3*b* the pad has been removed from one of the eyepieces in order to illustrate the relatively flat profile of the lower rim **44*a* compared to the more curved upper rim 40*a*. The lower wall 44*a* is flatter than in prior goggle designs, providing more boney support for the eyepiece. The profile of the upper rim 40*a*** is more curved so that it fits snugly against the bone underneath the brow.

The nose bridge 22 protrudes forward from the plane of the lens. The nose bridge 22 is preferably flexible and adjustable in length to accommodate noses of different sizes and shapes.

In keeping with the goals of providing relatively distortion-free forward and peripheral vision, the lens 14 is planar and extends laterally a sufficient distance to permit good lateral viewing. The relatively flat planar shape of the lens allows the swimmer to view the underwater environment with less distortion than prior goggles which employ curved lenses. Peripheral viewing is particularly important for competitive swimmers who need to be able to see their opponents in adjacent lanes. Due to the curvature of the user's face toward the lateral end of the eyepiece and the desire to use a relatively flat lens, the width of the eyepiece wall increases to a maximum along the ridge 20. In order to optimally accommodate the competing goals of allowing good peripheral distortion-free viewing while minimizing water resistance, the length of the ridge 20 is preferably approximately 30% of the length of lens 14. In the preferred embodiment the length 53 of the ridge 20 is approximately 0.5 inches.

Figure 4:
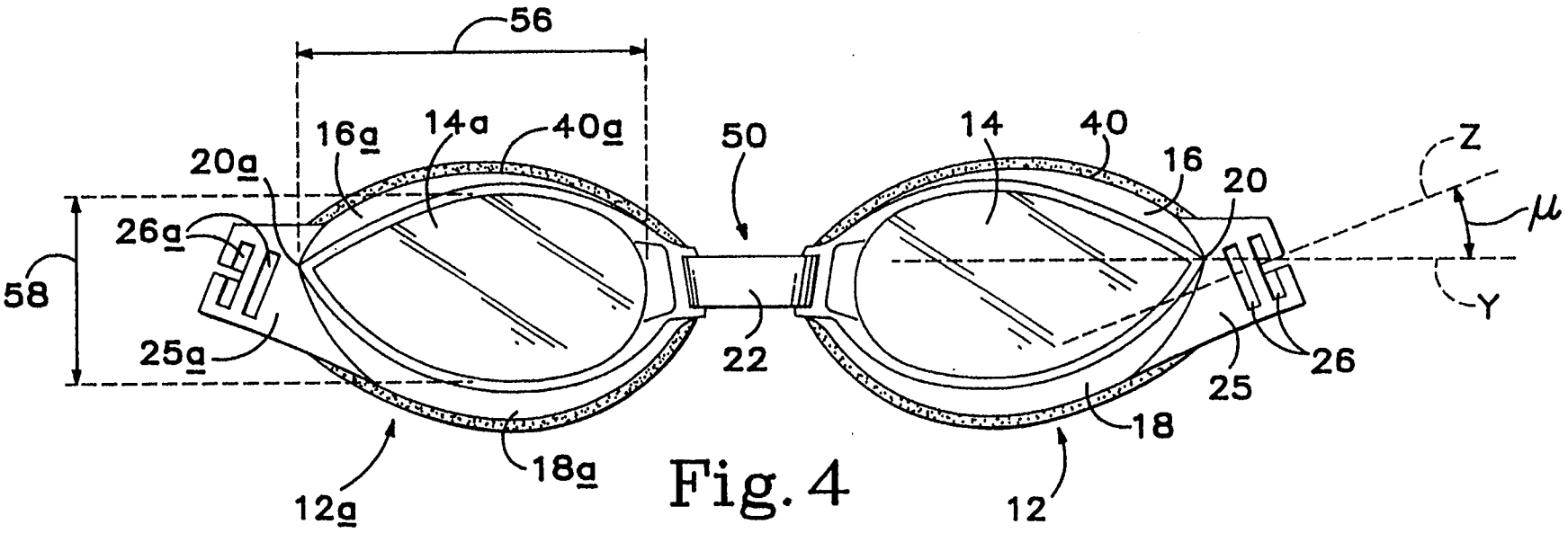
FIG. 4 is a front view of a pair of goggles in an embodiment of the present invention.

FIG. 4 shows a front view of a pair of goggles including right eyepiece **12*a* and left eyepiece 12. The right eyepiece 12*a* is a mirror image of the left eyepiece 12. It can be seen in FIG. 4 that the goggle lenses 14 and 14*a* are eye shaped forming distinct points at their lateral ends coinciding with the lateral ridges 20 and 20*a* of their respective eyepieces 12 and 12*a*. The length 56 of the lens 14 is approximately 1.8 inches and the width 58 of the lens 14 is approximately 1.1 inches. The ratio (l/w) of the eyepiece length (l) 56 to the eyepiece width (w) 58** is approximately 1.6, thus producing an eye-shaped eyepiece which provides more honey support compared to previous swim goggles. The planar eye shaped lens has been found to allow good peripheral viewing while minimizing undesirable water resistance when swimming or diving.

FIG. 4 illustrates the upward orientation of strap support flange 25 and the rectangular apertures 26. Each eyepiece has a lateral surface for receiving a fastener. In a preferred embodiment the distal edge of the flange 25 and the apertures 26 are perpendicular to an upward axis Z which forms an angle $\mu$ of approximately eighteen degrees with the horizontal axis Y of the eyepiece. The flange configuration orients the strap to pull the eyepiece upward against the inner side of the swimmer's supra-orbital border creating a more comfortable and efficient goggle design.

In use, each of the upper rims 40 and 40*a* of the goggle eyepieces are positioned significantly below and behind the user's eyebrow within the eye orbit. This is different from most prior goggle designs in which the upper rim of the eyepiece contacts the user's eyebrow. It has been found that the goggles of the present invention, by employing intra-orbitally engaging upper rims which fit well below the user's eyebrow within the orbit, are comfortable and significantly more efficient with respect to the goals of minimizing leakage and water resistance.

Figure 5:
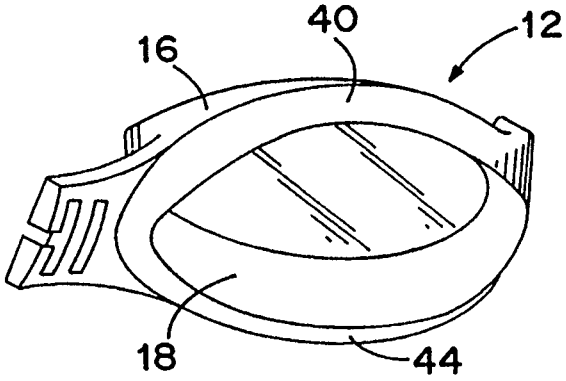
FIG. 5 is a back perspective view of the left eyepiece shown in FIGS. 1–4.

FIG. 5 shows the back of the eyepiece 12, particularly the contour of inwardly sloping rims 40 and 42 of the eyepiece walls 16 and 18 respectively.

The streamlined goggle design of the present invention provides several notable advantages. First, swimming speed is enhanced by decreasing water resistance. When a swimmer moves forward through the water in a horizontal position while diving, swimming or pushing off from a pool wall, the top side of the goggle eyepiece leads the bottom side. Conventional extra-orbitally fitting goggles, in which the upper wall protrudes significantly beyond the user's face, causes substantial water resistance. Whereas, in the present invention by limiting the width of the upper wall and by hiding a substantial portion of the upper wall within the user's eye orbit, an improved hydrodynamic streamlined goggle is produced. The streamlined feature of the goggles is particularly helpful for competitive swimmers who are concerned with maximizing their swimming or diving efficiency.

Second, prior goggles which fit extra-orbitally and protrude beyond the user's forehead are prone to dislodge from their optimal position when the user dives into a pool or pushes off from a pool wall. When goggles dislodge other problems result. For example, water may leak into the eyepiece around the eye. The swimmer may also be forced to interrupt his stroke to manually reposition the goggles. Such an occurrence during a competitive race could be disastrous. As explained above, in the intra-orbitally fitting goggle of the present invention, protrusion of the upper wall beyond the user's forehead is minimized, thus also minimizing the probability that the eyepiece will be dislodged due to water resistance forces.

The claimed invention is not intended to be limited to the preferred embodiments discussed above. Other alterations and improvements which are consistent with the spirit of the invention as described, are also claimed.

I claim:

1. Swim goggles comprising:

a set of left and right eyepieces, each eyepiece including a lens in a frontal plane, a lower wall and an upper wall, both walls extending backward from the lens and culminating in an intra-orbital engaging padded rim wherein a slope angle is defined by the slope of the rim relative to the frontal plane, the rim including an upper portion and a lower portion, the slope angle of the upper portion of the rim with respect to the frontal plane conforming to the slope angle of the user's supra-orbital bone with respect to the frontal plane;

a bridge connecting eyepieces; and a fastener for securing the eyepieces over the user's eyes, wherein each eyepiece has a lateral flange extending laterally upwardly from the side of the eyepiece for biasing the fastener to pull the eyepiece upward toward the user's upper supra-orbital bone.

2. The swim goggles of claim 1 wherein the flange has a distal edge and a plurality of elongated apertures for receiving a strap, a horizontal axis being defined by the length of the eyepiece lens, the distal edge and the apertures of the flange being substantially perpendicular to an upward axis approximately eighteen degrees above the horizontal axis.

3. The swim goggles of claim 1 where the average slope angle of the upper portion of the rim is at least approximately forty degrees.

4. The swim goggles of claim 3 wherein the slope angle of the upper portion of the rim is between approximately forty degrees and eighty degrees.

5. The swim goggles of claim 1 wherein the upper portion of the rim has a slope angle of approximately sixty degrees.

6. The swim goggles of claim 1 wherein each eyepiece has a length and a width, the ratio of the length to the width being approximately 1.6.

7. Swim goggles comprising:

a set of left and right eyepieces, each eyepiece including a substantially planar lens in a frontal plane, a wall extending backward from the lens culminating in a padded rim for engaging a portion of the user's face wherein an upper portion of the rim has a face which slopes downward relative to the frontal plane;

a bridge connecting the eyepieces, wherein the wall of each eyepiece includes top and bottom portions joined along a lateral ridge distal from the bridge and extending backward perpendicularly from the lens toward the user's ears; and a fastening mechanism for securing the eyepieces over the user's eyes.

8. The swim goggles of claim 7 wherein the ridge has a length extending from the lens to the rim and the lens has a length extending in a lateral direction from the user's nose toward a side of the user's face, the length of the ridge being approximately thirty percent of the length of the lens.

9. The swim goggles of claim 7 wherein the lens is eye-shaped and tapered to a point coinciding with a forward end of the lateral ridge.

10. The swim goggles of claim 9 wherein the lens is a separate piece from the eyepiece wall and the eyepiece wall has a forward edge, the forward edge being stepped inward to receive the lens.

11. The swim goggles of claim 8 wherein a portion of the rim adjacent the top portion of the wall faces the roof of the user's eye orbit when the goggles are worn.

12. Swim goggles comprising:

a set of left and right eyepieces, each eyepiece including a substantially planar lens, a wall extending backward from the lens culminating in a padded rim for engaging a portion of the use's face;

a bridge connecting the eyepieces, wherein the wall of each eyepiece includes top and bottom portions joined along a lateral ridge distal from the bridge and extending backward perpendicularly from the lens toward the user's ears;

a fastening mechanism for securing the eyepieces over the user's eyes;

wherein the ridge has a length extending from the lens to the rim and the lens has a length extending in a lateral direction from the user's nose toward a side of the user's face, the length of the ridge being approximately thirty percent of the length of the lens;

wherein a portion of the rim adjacent the top portion of the wall faces the roof of the user's eye orbit when the goggles are worn and the rim portion has a slope forming an angle with the lens between forty degrees and eighty degrees.

13. The swim goggles of claim 12 wherein the angle is approximately sixty degrees.

14. Swim goggles comprising:

a set of left and right eyepieces, each eyepiece including a substantially planar lens, a wall extending backward from the lens culminating in a padded rim for engaging a portion of the user's face;

a bridge connecting the eyepieces, wherein the wall of each eyepiece includes top and bottom portions joined along a lateral ridge distal from the bridge and extending backward perpendicularly from the lens toward the user's ears;

a fastening mechanism for securing the eyepieces over the user's eyes;

wherein the wall of each eyepiece has an upper portion and a lower portion, each of the wall portions have an intermediate width, the width of the lower wall portion being approximately three times as long as the width of the upper wall portion.

15. An intra-orbital engaging eyepiece for use in a pair of swim goggles comprising:

a lens in a frontal plane;

a wall extending backward from the lens and culminating in a padded rim, where an upper portion of the rim is sloped downward relative to the frontal plane and the rim has a circumference small enough to fit substantially within the user's eye orbit, wherein the rim faces the user's intra-orbital wall, and the wall has a lateral ridge, and the lens is eye shaped and pointed at one end coinciding with the ridge of the wall.

16. Swim goggles comprising:

a set of left and right eyepieces, each eyepiece including a lens in a frontal plane, a lower wall and an upper wall, both walls extending backward from the lens and culminating in an intra-orbital engaging padded rim wherein a slope angle is defined by the slope of the rim relative to the frontal plane, the rim including an upper portion and a lower portion, the slope angle of the upper portion being in conformance with the natural contours of the user's upper supra-orbital bone;

a bridge connecting the eyepieces; and a fastener for pulling the eyepiece rims against the user's supra-orbital bone.

17. The swim goggles of claim 16 wherein each eyepiece has a lateral surface and a horizontal axis, the fastener being connected to the lateral surface and extending upward relative to the horizontal axis.

* * * * *